US007271552B2

(12) United States Patent
Van Den Berg

(10) Patent No.: US 7,271,552 B2
(45) Date of Patent: Sep. 18, 2007

(54) BALLAST CIRCUIT FOR OPERATING A GAS DISCHARGE LAMP

(76) Inventor: Arjan Van Den Berg, Gerstweg 2, 6534 AE Nijmegen (NL)

( * ) Notice: Subject to any disclaimer, the term of this patent is extended or adjusted under 35 U.S.C. 154(b) by 152 days.

(21) Appl. No.: 10/520,867

(22) PCT Filed: Jun. 25, 2003

(86) PCT No.: PCT/IB03/02855

§ 371 (c)(1),
(2), (4) Date: Jan. 11, 2005

(87) PCT Pub. No.: WO2004/008814

PCT Pub. Date: Jan. 22, 2004

(65) Prior Publication Data

US 2005/0174069 A1 Aug. 11, 2005

(30) Foreign Application Priority Data

Jul. 15, 2002 (EP) ..... 02077841

(51) Int. Cl.
*G05F 1/00* (2006.01)

(52) U.S. Cl. ..... 315/307; 315/291; 315/DIG. 5

(58) Field of Classification Search ..... 315/209 PZ, 315/276, 282, 289–291, 307, 224, 244, 308, 315/209 R, 225, 272, 275, 312, 360, DIG. 5
See application file for complete search history.

(56) References Cited

U.S. PATENT DOCUMENTS 4,277,728 A 7/1981 Stevens ..... 315/307
5,233,273 A * 8/1993 Waki et al. ..... 315/224
5,825,136 A * 10/1998 Rudolph ..... 315/291
6,137,240 A * 10/2000 Bogdan ..... 315/307
6,160,362 A * 12/2000 Shone et al. ..... 315/308
6,541,923 B1 * 4/2003 Tyson ..... 315/224
6,747,421 B2 * 6/2004 Kohn ..... 315/291
6,794,828 B2 * 9/2004 Tyson ..... 315/244
2001/0035721 A1 11/2001 Halberstadt ..... 315/307

* cited by examiner

*Primary Examiner*—Douglas W. Owens
*Assistant Examiner*—Jimmy Vu
(74) *Attorney, Agent, or Firm*—Peter Zawilski

(57) ABSTRACT

Ballast circuit for operating a gas discharge lamp, comprising a half-bridge DC-AC converter having a voltage controlled oscillator (VCO) for alternately switching the switches (T1; T2) of said half-bridge, said oscillator (VCO) having an input with a control voltage (V vco) which determines the operating frequency of said half-bridge, a resonance circuit connected to said half-bridge for feeding the lamp, and a feedback circuit connected at a first end to said resonance circuit for adjusting the operating frequency of said half-bridge, wherein the other end of said feedback circuit is connected to the input of said voltage controlled oscillator (VCO) and designed such that during at least a substantial part of the start-up period of the lamp an equilibrium exists wherein the half-bridge frequency is at least nearly equal to the resonance frequency and the half-bridge voltage is forced to operate at least nearly in phase with the half-bridge current.

6 Claims, 2 Drawing Sheets

BALLAST CIRCUIT FOR OPERATING A GAS DISCHARGE LAMP

FIELD OF THE INVENTION

Figure 1:
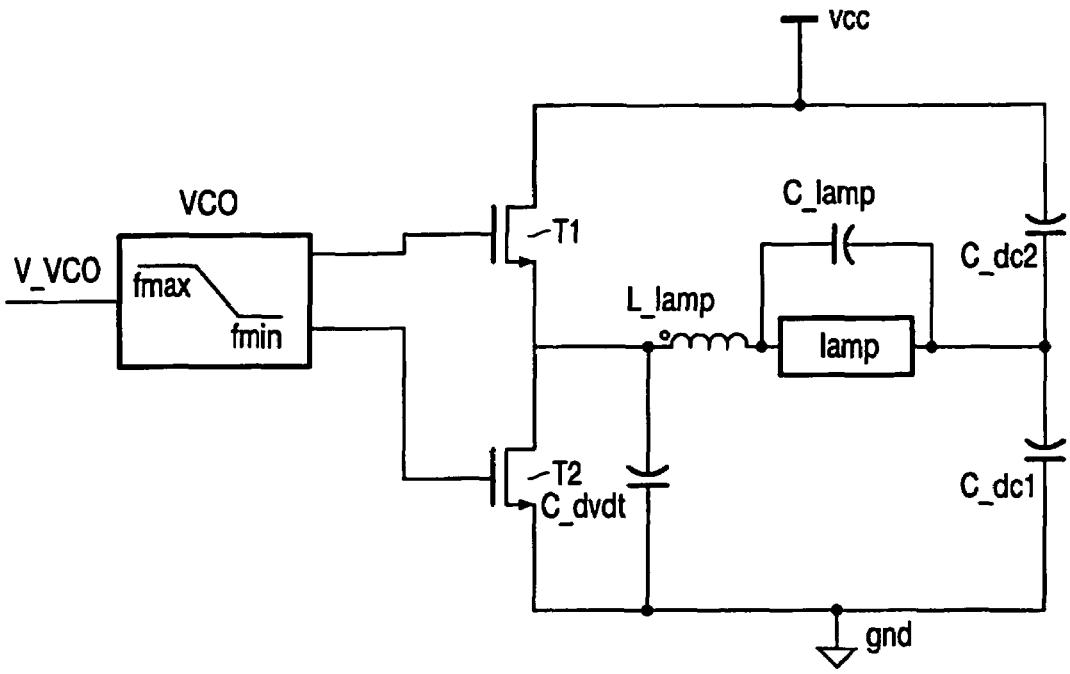

The invention relates to a ballast circuit for operating a gas discharge lamp, comprising a half-bridge DC-AC converter having a voltage controlled oscillator for alternately switching the switches of said half-bridge, said oscillator having an input with a control voltage which determines the operating frequency of said half-bridge, a resonance circuit connected to said half-bridge for feeding the lamp, and a feedback circuit connected at one end to said resonance circuit for adjusting the operating frequency of said half-bridge.

BACKGROUND OF THE INVENTION

Such a ballast circuit is described in U.S. Pat. No. 5,723,953.

For igniting a (compact) fluorescent lamp two methods can be applied: warm start or cold start. Warm start means that during a specific time the electrodes are pre-heated while maintaining the lamp voltage below its ignition voltage. Because of the high electrode temperature the electrodes will start emitting electrons. When after pre-heating a lamp voltage is applied which is larger than the ignition voltage, an avalanche will take place and the fluorescent lamp will be on. As electrons are already available, the voltage across the electrodes is low during and after the ignition process, so no sputtering of the electrodes will occur, that is reflected in a high switching lifetime of the lamp.

For a cold start a high voltage is applied across the fluorescent lamp in a very short time. After ignition the electrodes needs to supply electrons to establish a lamp current. However the electrodes are cold and the only manner to generate electrons is to force them out of the electrode lattice by a high electric field. This high voltage will heat the electrode and eventually thermal emission will take place. In the time frame wherein the electrode voltage is high, the so called glow phase, sputtering of the electrode will take place that is reflected in a relatively short switching lifetime. The lamp driver should take care that the time frame wherein the electrode voltage is high is as short as possible. This means that in the glow phase maximum power should be delivered to the lamp to heat up the electrodes as quickly as possible. The lamp voltage during the glow phase is high (typically 500V, depending on the lamp type). The reason to apply the cold start mechanism is to minimize the costs of the ballast.

A lamp driver usually consists of a half-bridge topology. The pre-heating, ignition and burning states are obtained by sweeping down the frequency of the half-bridge switches over the resonance curve of the resonance (LC) network. The resonance frequency (1/(2*pi*sqrt(Llamp*Clamp)) often is chosen near the start frequency (the maximum frequency) for lowest current stress during ignition. Sweeping is often established via a voltage controlled oscillator.

For cold start the frequency sweep from the start frequency to the nominal frequency (the minimum frequency) is very short, for instance 10 ms, with respect to the glow time, which is more than 100 ms. Therefore without any measures the half-bridge will run at nominal frequency during the glow phase. Because this nominal frequency is far below the resonance frequency the half-bridge is not capable anymore of generating the high glow voltage, and furthermore the half bridge is also running in capacitive mode. As a result the lamp may extinguish, or alternatively remain in glow mode and be destroyed thereby. Known cold start lamp drivers which address this problem have non-integrated self-oscillating circuits which direct itself to resonance and thereby maximum power to the lamp in the glow phase. These circuits are however expensive and hard to integrate in an IC.

SUMMARY OF THE INVENTION

The aim of the invention is to provide a cheap and efficient integrated ballast circuit for operating a gas discharge lamp, which controls a resonant half-bridge lamp driver for maximum power during the glow phase.

Therefore the other end of said feedback circuit is connected to the input of said voltage controlled oscillator and designed such that during at least a substantial part of the start-up period of the lamp wherein the half-bridge frequency is at least nearly equal to the resonance frequency the half-bridge voltage is forced to operate at least nearly in phase with the half-bridge current. Said feedback loop thereby automatically maintains the ballast at resonance frequency, and thereby at maximum power, from the moment the frequency down sweep reaches said resonance frequency until the lamp is on.

Preferably the first end of the feedback circuit is connected to the serial connection between the two switches of the half-bridge. Also preferably said voltage controlled oscillator input is further connected to a current source and a capacitor, wherein said equilibrium is determined by said current source charging said capacitor, and said feedback circuit at least partially discharging said capacitor each half-bridge switching cycle.

The ballast circuit described herein is in particular suited to be integrated in an IC.

The invention furthermore relates to a lamp driver comprising said ballast circuit.

BRIEF DESCRIPTION OF THE INVENTION

The invention will now be explained in more detail with respect to the drawings, which show an exemplary embodiment of the invention merely for the purpose of illustration.

Figure 2:
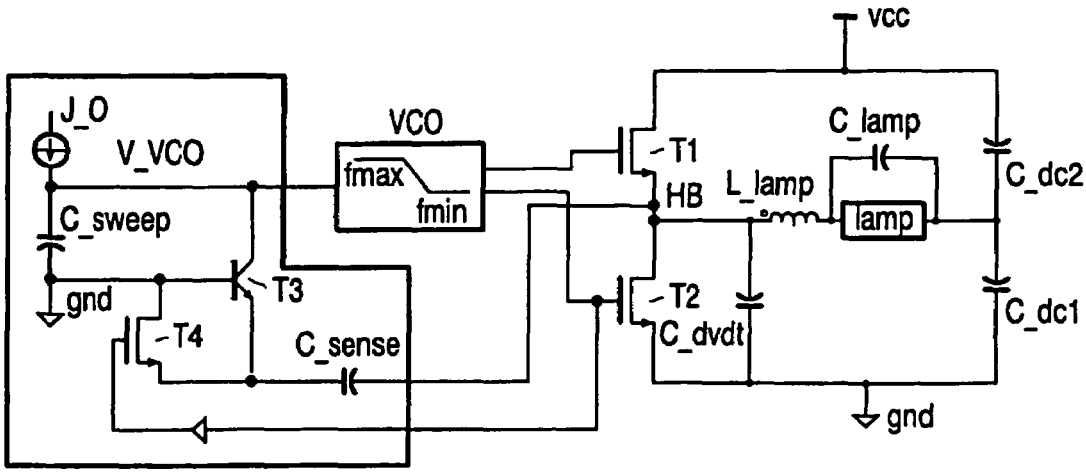
Figure 3:
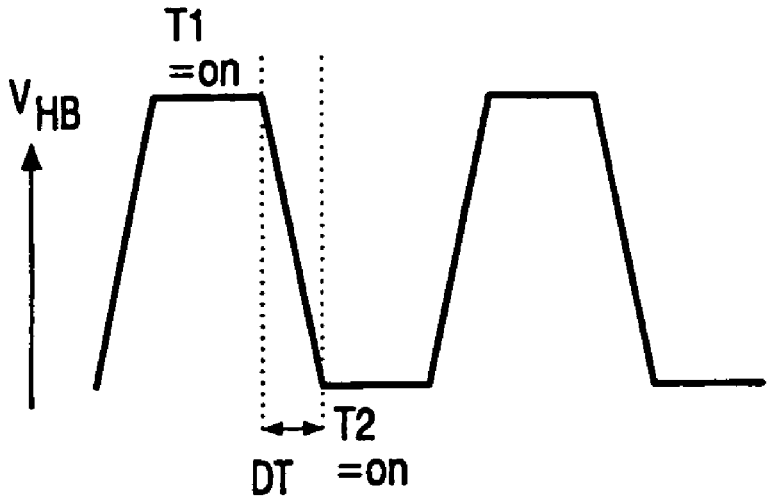
Figure 4:
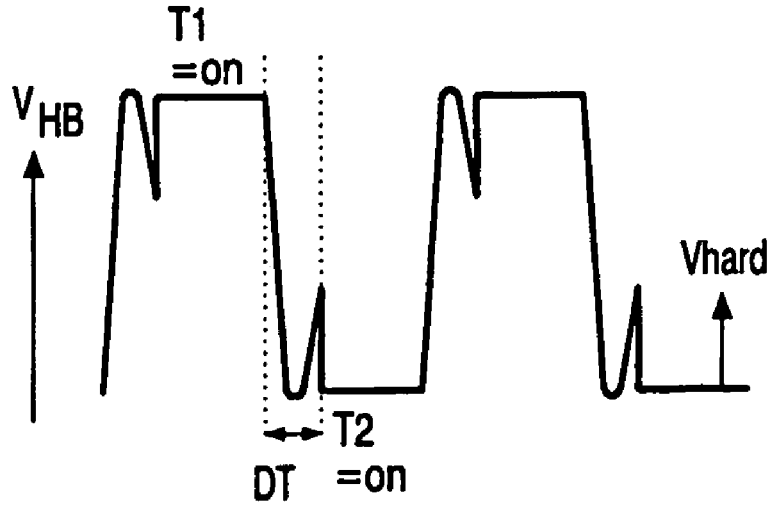

FIG. 1 schematically shows a conventional ballast circuit;

FIG. 2 schematically shows a ballast circuit according the invention;

FIG. 3 shows a time plot of a the half-bridge voltage of a ballast circuit operating in inductive mode; and FIG. 4 shows a time plot of the half-bridge voltage of a ballast circuit according the invention operating in near-resonance mode.

DETAIL DESCRIPTION OF THE INVENTION

According to FIG. 1 a typical ballast circuit for driving a gas discharge lamp comprises a DC voltage terminal (vcc) and a ground terminal (gnd), a compact fluorescent lamp, capacitors C_lamp, C_dc1, C_dc2 and C-dvdt, and a coil L_lamp. Furthermore the ballast circuit comprises a half-bridge DC-AC converter, consisting of two mosfet switches T1 and T2, which are switched by a voltage controlled oscillator VCO. The switching frequency of oscillator VCO is determined by an input voltage V_vco, wherein the frequency is highest if said input voltage is low (for instance 0 V), and lowest if said input voltage is high.

The man skilled in the art will appreciate that the resonance circuit of FIG. 1 is shown for illustration purposes and may have any other suitable configuration without departing from the scope of the invention.

According to FIG. 2 a feedback circuit is added to the ballast circuit of FIG. 1. One end of the feedback circuit is connected to a node HB located between the two switches T1 and T2 of the half-bridge. The other end of the feedback circuit is connected to the control voltage input of the voltage controlled oscillator VCO. The feedback circuit comprises capacitors C_sense, a switch T4 and a transistor T3, T2 and T4 are coupled such that T4 is on if T2 is off, and vice versa.

The frequency down sweep of the voltage controlled oscillator VCO is achieved by a current source J_0 and capacitor C_sweep, in between which the VCO input is connected. When the ballast is switched on the current source J_0 starts to load capacitor C_sweep and thereby the control voltage V_vco rises while the switching frequency of the VCO goes down, thereby approaching the resonance frequency of the resonance circuit. As long as the operating frequency is (much) higher than the resonance frequency the resonance circuit is operating in inductive mode, as reflected in FIG. 3. In that case the voltage across T2 is zero when T2 is switched on.

However, near resonance the phase angle between the half-bridge current and the half-bridge voltage becomes so small that, given a fixed dead time DT, wherein both T1 and T2 are off, the half-bridge voltage starts to swing back during the dead time, as shown in FIG. 4. Therefore, when T2 is switched on there is a negative voltage step VHard at the half-bridge node HB. This results in discharging C_sweep via T3 and C_sense, and thereby a lower control voltage V_vco and a higher operating frequency.

These two opposite forces, i.e. the charging of C_sweep by current source J_0 and the partial discharging of C_sweep when T2 is switched on, forces the ballast towards an equilibrium wherein V-vco remains constant, and thus the ballast operates at near-resonance frequency wherein the half-bridge current and the half-bridge voltage are (nearly) in phase and maximum power is fed to the lamp until the lamp is on.

The amount of charge involved in the discharging of C_sweep equals Vhard*C_sense. The equilibrium thus exists when:

$$(J_0*T)-(V\text{hard}*C_\text{sense})=0$$

Given the frequency f=1/T, Vhard can be expressed as follows:

$$V\text{hard}=J_0/(f*C_\text{sense})$$

For example, if J_0=250 nA, f=50 kHz and C_sense=330 fF, then Vhard=15 V. So the system controls itself so close to resonance that just before switching on the lowside/highside power the drain source voltage equals 15 V. Thus no dedicated control loop is necessary.

The invention claimed is:

1. Ballast circuit for operating gas discharge lamp, comprising a half-bridge DC-AC converter having a voltage controlled oscillator for alternating switching two switches of said half-bridge, said oscillator having an input with a control voltage which determines an operating frequency of said half-bridge;

a resonance circuit connected to said half-bridge for feeding the lamp; and a feedback circuit connected at a first end to said resonance circuit for adjusting the operating frequency of said half-bridge, characterized in that the other end of said feedback circuit is connected to the input of said voltage controlled oscillator and designed such that during at least a substantial part of a start-up period of the lamp an equilibrium exists wherein the half-bridge frequency is at least nearly equal to a resonance frequency and a half-bridge voltage is forced to operate at last nearly in phase with a half-bridge current; and characterized in that said oscillator input is further connected to a current supply and a capacitor, wherein said equilibrium is determined by said currently supply loading said capacitor, and said feedback circuit at least partially unloading said capacitor each half-bridge switching cycle.

2. Ballast circuit according to claim 1 characterized in that the first end of the feedback circuit is connected to a serial connection between the two switches of the half-bridge.

3. Ballast circuit according to claim 1, characterized in that the ballast circuit is integrated in an IC.

4. Lamp driver for operating a gas discharge lamp using a ballast circuit, the lamp driver comprising:

a half-bridge DC-AC converter having a voltage controlled oscilator for alternating switching two switches of said half-bridge, said oscillator having an input with a control voltage which determines an operating frequency of said half-bridge;

a resonance circuit connected to said half-bridge for feeding the lamp; and a feedback circuit connected at a first end to said resonance circuit for adjusting the operating frequency of said half bridge, characterized in that the other end of said feedback circuit is connected to the input of said voltage controlled oscillator and designed such that during at least substantial part of a start-up period of the lamp an equilibrium exists wherein the half-bridge frequency is at least nearly equal to a resonance frequency and a half bridge voltage is forced to operate at last nearly in phase with a half-bridge current; and characterized in that said oscillator input is further connected to a current supply and a capacitor, wherein said equilibrium is determined by said currently supply loading said capacitor, and said feedback circuit at least partially unloading said capacitor each half-bridge switching cycle.

5. The lamp driver according to claim 4 characterized in that the first end of the feedback circuit is connected to a serial connection between the two switches of the half-bridge.

6. The lamp driver according to claim 4, characterized in that the ballast circuit is integrated in an IC.

* * * * *